US010866024B2

(12) United States Patent
Patrice et al.

(10) Patent No.: US 10,866,024 B2
(45) Date of Patent: Dec. 15, 2020

(54) DEVICE AND METHOD FOR SEPARATING AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Cavagne Patrice, Le Perreux (FR); Nicolas Chamontin, Paris (FR); Benedicte Dos Santos, Annet sur Marne (FR); Laurent Richaume, Paris (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 0 days.

(21) Appl. No.: 16/054,213

(22) Filed: Aug. 3, 2018

(65) Prior Publication Data

US 2019/0041129 A1 Feb. 7, 2019

(30) Foreign Application Priority Data

Aug. 3, 2017 (FR) ..... 17 57493
Aug. 3, 2017 (FR) ..... 17 57495
(Continued)

(51) Int. Cl.
*F25J 3/04* (2006.01)
*F25J 3/02* (2006.01)

(52) U.S. Cl.
CPC ..... *F25J 3/04818* (2013.01); *F25J 3/0295* (2013.01); *F25J 3/0406* (2013.01);
(Continued)

(58) Field of Classification Search
CPC .... F25J 3/04818; F25J 3/0295; F25J 3/04012; F25J 3/0406; F25J 3/04406;
(Continued)

(56) References Cited

U.S. PATENT DOCUMENTS 2,113,680 A 4/1938 De Baufre
2,664,718 A 1/1954 Rice
(Continued)

FOREIGN PATENT DOCUMENTS

CN 201 173 660 12/2008
DE 102 09 421 4/2003
(Continued)

OTHER PUBLICATIONS

French Search Report and Written Opinion for FR 1 757 497, dated Mar. 19, 2018.
(Continued)

*Primary Examiner* — Brian M King
(74) *Attorney, Agent, or Firm* — Justin K. Murray

(57) ABSTRACT

Method for separating air by cryogenic distillation, wherein at least part of the air to be distilled is boosted in an air booster, compressed air is allowed to expand in at least one expansion turbine and, if the pressure drop between two points of the booster passes under a threshold and/or a flow of the booster passes under a minimum flow of the booster, part of the air boosted in the booster is allowed to expand without having been cooled between the booster and the expansion turbine and the boosted expanded air is sent upstream or downstream of the at least one turbine, without having been cooled in the heat exchanger, after having been boosted.

11 Claims, 1 Drawing Sheet

(30) Foreign Application Priority Data

Aug. 3, 2017 (FR) ..... 17 57497
Aug. 3, 2017 (FR) ..... 17 57498

(52) U.S. Cl.
CPC ..... *F25J 3/04012* (2013.01); *F25J 3/0423* (2013.01); *F25J 3/04024* (2013.01); *F25J 3/04066* (2013.01); *F25J 3/0486* (2013.01); *F25J 3/04109* (2013.01); *F25J 3/04127* (2013.01); *F25J 3/04187* (2013.01); *F25J 3/04193* (2013.01); *F25J 3/04254* (2013.01); *F25J 3/04296* (2013.01); *F25J 3/04381* (2013.01); *F25J 3/04393* (2013.01); *F25J 3/04406* (2013.01); *F25J 3/04412* (2013.01); *F25J 3/04775* (2013.01); *F25J 3/04787* (2013.01); *F25J 3/04812* (2013.01); *F25J 3/04824* (2013.01); *F25J 3/04866* (2013.01); *F25J 3/04896* (2013.01); *F25J 2200/04* (2013.01); *F25J 2215/42* (2013.01); *F25J 2215/50* (2013.01); *F25J 2230/22* (2013.01); *F25J 2230/40* (2013.01); *F25J 2240/04* (2013.01); *F25J 2240/10* (2013.01); *F25J 2240/42* (2013.01); *F25J 2245/40* (2013.01); *F25J 2280/10* (2013.01); *F25J 2280/20* (2013.01); *F25J 2290/12* (2013.01)

(58) Field of Classification Search
CPC .... F25J 3/04775; F25J 3/0481; F25J 3/04375; F25J 3/04393; F25J 3/04812; F25J 2280/10; F25J 2230/22; F25J 2215/40
See application file for complete search history.

(56) References Cited

U.S. PATENT DOCUMENTS

| | | | | |
|---|---|---|---|---|
| 5,596,885 | A * | 1/1997 | Grenier | F25J 3/04018 62/646 |
| 2004/0050095 | A1 | 3/2004 | Brigham et al. | |
| 2004/0221612 | A1* | 11/2004 | Jaouani | F25J 3/04054 62/656 |
| 2009/0241595 | A1* | 10/2009 | Chinta | F25J 3/04024 62/644 |
| 2012/0047943 | A1* | 3/2012 | Barclay | C10L 3/10 62/613 |
| 2012/0118006 | A1* | 5/2012 | Judas | F25J 3/04054 62/606 |

FOREIGN PATENT DOCUMENTS

| | | |
|---|---|---|
| DE | 10 2006 027650 | 2/2007 |
| DE | 10 2011 121314 | 6/2013 |
| DE | 10 2013 002094 | 8/2014 |
| EP | 0 611 936 | 8/1994 |
| EP | 0 644 388 | 3/1995 |
| EP | 1 014 020 | 6/2000 |
| EP | 1 055 894 | 11/2000 |
| EP | 1 711 765 | 10/2006 |
| EP | 1 782 011 | 5/2007 |
| EP | 2 458 311 | 5/2012 |
| EP | 2 482 016 | 8/2012 |
| EP | 2 489 968 | 8/2012 |
| EP | 2 600 090 | 6/2013 |
| EP | 2 831 525 | 2/2015 |
| EP | 2 963 369 | 1/2016 |
| EP | 2 963 370 | 1/2016 |
| FR | 2 721 383 | 12/1995 |
| FR | 2 851 330 | 8/2004 |
| FR | 2 861 841 | 5/2005 |
| FR | 2 895 068 | 6/2007 |
| FR | 2 913 670 | 9/2008 |
| FR | 2 913 759 | 9/2008 |
| FR | 2 943 408 | 9/2010 |
| FR | 2 985 305 | 7/2013 |
| FR | 3 010 778 | 3/2015 |
| FR | 3 033 397 | 9/2016 |
| GB | 1 500 610 | 2/1978 |
| JP | S54 162 678 | 12/1979 |
| JP | 2005 221 199 | 8/2005 |
| JP | 2015 114 083 | 6/2015 |
| WO | WO 2005 064252 | 7/2005 |
| WO | WO 2015 082 860 | 6/2015 |

OTHER PUBLICATIONS

French Search Report and Written Opinion for FR 1 757 493, dated Mar. 19, 2018.
French Search Report and Written Opinion for FR 1 757 495, dated Mar. 20, 2018.
French Search Report and Written Opinion for FR 1 757 498, dated Mar. 1, 2018.
Macconnell, "Process Control and Optimization," Separation Controls, Air Instrument Engineers Handbook, vol. II, Chapter 8.37, Jan. 1, 2006, pp. 2123-2136.
EP Search Report and Written Opinion for EP 18186654, dated Dec. 10, 2018.

* cited by examiner

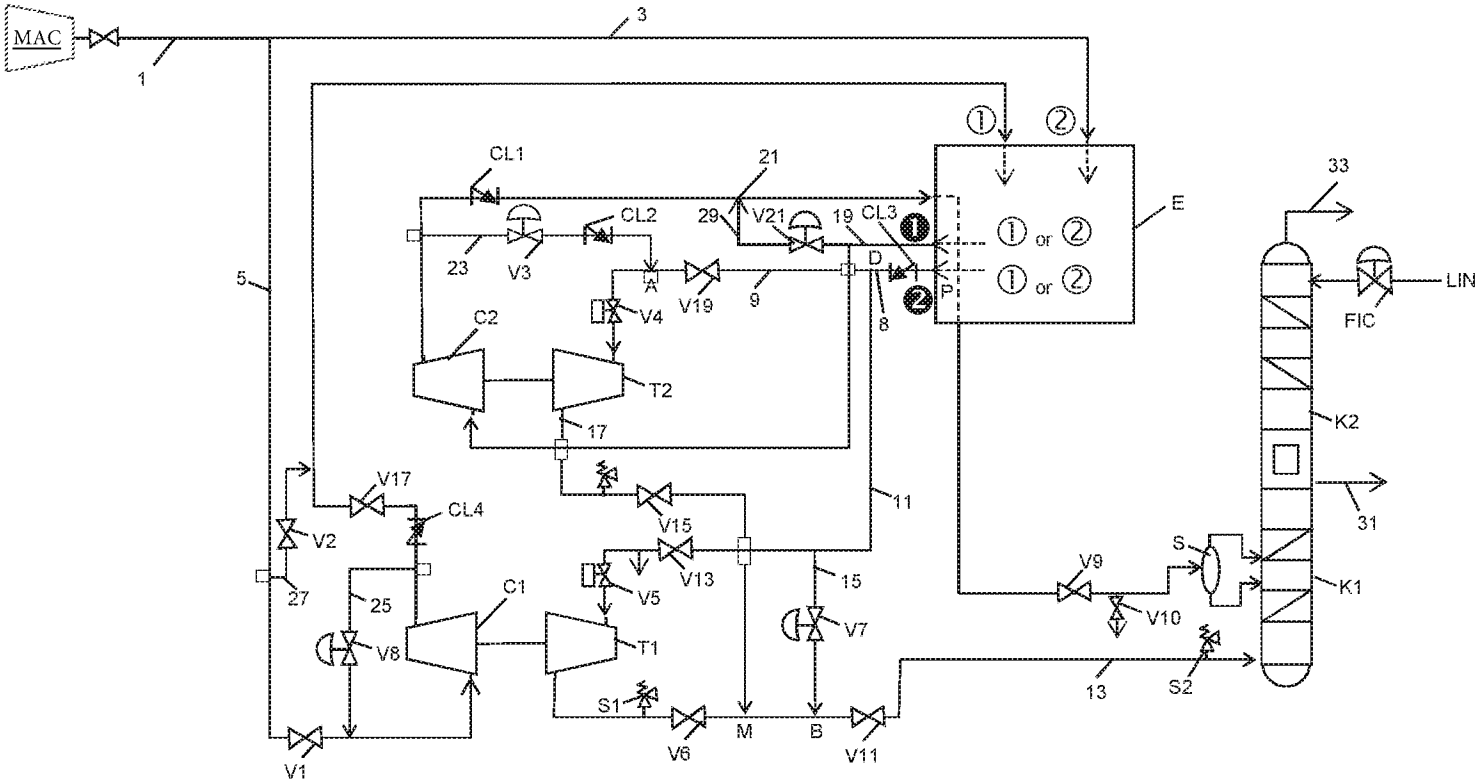
MAC
1
3
5
E
LIN
FIC
33
K2
31
K1
S
S2
V10
V9
13
11
15
V7
V11
B
M
V6
S1
T1
V5
V13
V15
C1
CL4
V17
V8
25
V2
27
V1
T2
V4
17
C2
V3
CL1
23
CL2
A
V19
29
21
V21
9
19
CL3
D
8
P
1 or 2
1 or 2

DEVICE AND METHOD FOR SEPARATING AIR BY CRYOGENIC DISTILLATION

CROSS REFERENCE TO RELATED APPLICATIONS

This application claims the benefit of priority under 35 U.S.C. § 119 (a) and (b) to French patent application No. FR1757493, filed Aug. 3, 2017, French patent application No. FR1757495, filed Aug. 3, 2017, French patent application No. FR1757497, filed Aug. 3, 2017, and French patent application No. FR1757498, filed Aug. 3, 2017, the entire contents of which are incorporated herein by reference.

FIELD OF THE INVENTION

The present invention relates to a device and to a method for separating air by cryogenic distillation. It particularly relates to devices using a supply air booster supplied with air originating from an intermediate level of a main exchanger for cooling supply air, thus at a temperature below 0° C. This air is subsequently boosted in the booster and is sent to the main exchanger before being sent to a cryogenic distillation column.

BACKGROUND

When the pressure difference between the inlet and the outlet of a compressor becomes too high, instabilities, referred to as separation, occur on the blades of the compressor. Aerodynamic stalling no longer allows the air to be pushed in the correct direction and the "high-pressure" part of the compressor (the outlet) empties into its "low-pressure" part (the inlet). In some extreme cases, a reversal of the direction of flow can even occur.

These significant flow fluctuations are called pumping, due to the nature of this phenomenon of aerodynamic instability, which gives rise to longitudinal waves. If, by increasing the rotation speed, the pressure difference between the inlet and the outlet of a compressor increases, this pressure increase is limited by this pumping phenomenon. When the compression ratio exceeds a critical value, pumping occurs and the increase in the rotation speed of the compressor will virtually no longer affect the compression ratio.

If this phenomenon levels the performance of the compressors, it is also sometimes very destructive for the compressors.

In general, when the imminence of pumping is detected, part of the air compressed in the compressor is returned upstream of the compressor after cooling, followed by expansion in a valve.

In the case of a cold booster, in order to reduce costs, it is desirable for the coolant to be removed downstream of the boosting and upstream of the heat exchanger. Such a device is known from FR-A-2851330.

It is possible to contemplate returning the air boosted in the cold booster to the specific suction side in the event of pumping and of cooling the boosted air to be returned to the suction side in dedicated passages of the heat exchanger, but the solution risks being expensive by increasing the complexity of the exchanger.

SUMMARY OF THE INVENTION

Certain embodiments of the present invention allow the problem to be overcome by opening a valve towards a turbine downstream of the compressor, in order to increase the flow in the compressor and thus exit the pumping zone.

According to one aim of the invention, a device is provided for separating air by cryogenic distillation, comprising an air compressor for compressing all the air to be distilled, an air booster for boosting at least part of the air to be distilled, an expansion turbine for receiving compressed air originating from the compressor and optionally from the air booster, a system of cryogenic distillation columns comprising at least one column, a heat exchanger, means for sending air from the compressor to the heat exchanger, which has two ends, means for bleeding cooled air at an intermediate point of the heat exchanger between the two ends and for sending cooled air to the booster, means for sending boosted air from the booster to the heat exchanger, means for sending air cooled in the heat exchanger to the turbine, means for sending air allowed to expand in the turbine to the system of columns, means for extracting an oxygen enriched flow and a nitrogen enriched flow from the system of columns, said means being connected to the heat exchanger, means for allowing the boosted air in the booster to expand, no cooling means between the discharge of the booster and the means for allowing the boosted air to expand and means for sending air, boosted in the booster and allowed to expand by the expansion means, upstream or downstream of the turbine, without having been cooled in the heat exchanger after having been boosted, characterised in that it comprises means for detecting the pressure drop or the flow between two points of the booster, as well as means for opening the expansion means, for example, a valve, for sending the boosted air upstream or downstream of the turbine, without passing through the heat exchanger, only if the pressure drop or the flow of the booster exceeds a threshold indicating that pumping is imminent.

The booster can be connected to the inlet of the turbine so that the boosted air can at least partly expand in the turbine.

According to another aspect of the invention, a method is provided for separating air by cryogenic distillation, wherein all the air to be distilled is compressed in an air compressor, at least part of the air to be distilled that is compressed in the air compressor is boosted in an air booster, compressed air originating from the compressor and optionally from the air booster is allowed to expand in at least one expansion turbine, compressed air cooled in a heat exchanger is separated in a system of cryogenic distillation columns comprising at least one column, cooled air is bled at an intermediate point of the heat exchanger between the two ends thereof in order to be sent to the booster, boosted air is sent from the booster to the heat exchanger, air cooled in the heat exchanger is sent to the turbine, air allowed to expand in the turbine is sent to the system of columns, an oxygen enriched flow and a nitrogen enriched flow is extracted from the system of columns and said flows are heated in the heat exchanger, characterised in that:

i) if the pressure drop between two points of the booster passes under a threshold indicating that the pumping point is imminent; or ii) a flow of the booster passes under a minimum flow of the booster indicating that the pumping point is imminent, part of the air boosted in the booster is allowed to expand without having been cooled between the booster and the expansion turbine and the boosted expanded air is sent upstream or downstream of the at least one turbine, without having been cooled in the heat exchanger, after having been boosted and, in the event of case ii), the flow in the booster is increased in order to exit the pumping zone.

According to other optional aspects:

if, preferably only if, the pressure drop between the two points is above the threshold and/or a flow of the booster exceeds the minimum flow of the booster, all the air is sent from the booster to the heat exchanger in order to be cooled;

if the pressure drop between the two points of the booster passes under the threshold and/or a flow of the booster passes under the minimum flow of the booster, none of the boosted air is sent upstream of the booster;

boosted and expanded air is allowed to expand in the turbine if the pressure drop between the two points of the booster passes under the threshold and/or a flow of the booster passes under the minimum flow of the booster and preferably no air flow originating from the booster is allowed to expand in the turbine if the pressure drop between the two points of the booster is above the threshold and/or a flow of the booster rises above the minimum flow;

if the pressure drop between the two points of the booster passes under the threshold (and/or a flow of the booster passes under the minimum flow), the boosted air is allowed to expand to the pressure of a column of the system of columns, is mixed with the air originating from the turbine and is sent to the column;

the separation method is carried out in a cryogenic distillation separation device;

if the pressure drop between the two points of the booster is above the threshold or the flow of the booster is above the minimum flow, all the boosted air is sent to cool in the heat exchanger;

the boosted expanded air sent to the turbine is sent to a turbine coupled to the booster from which the air originates;

the boosted expanded air sent to the turbine is sent to a turbine receiving air, even all the air that it allows to expand, from the booster;

the turbine receives air from the booster only in the event that the pressure drop between the two points of the booster is below the threshold;

if the pressure drop between two points of the booster passes under a threshold and/or a flow of the booster passes under a minimum flow of the booster, part of the air boosted in the booster is allowed to expand in expansion means other than a turbine;

if the pressure drop between two points of the booster passes under a threshold and/or a flow of the booster passes under a minimum flow of the booster, part of the air boosted in the booster is allowed to expand in a valve;

if the pressure drop between two points of the booster passes under a threshold and/or a flow of the booster passes under a minimum flow of the booster, part of the air boosted in the booster is allowed to expand to an inlet or outlet pressure of a turbine of the device, even to the pressure of a column of the device;

the inlet temperature of the air booster is between 0° C. and −180° C., even between −60° C. and −180° C.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The invention will be described in further detail with reference to the figure, which shows a device for separating air by cryogenic distillation according to the invention.

DETAILED DESCRIPTION OF THE INVENTION

The device comprises a system of columns comprising a column operating at a first pressure K1 and a column operating at a second pressure K2 below the second pressure. The columns are thermally connected through a bottom reboiler of the second column heated by nitrogen from the top of the first column. Nitrogen and oxygen enriched reflux flows, not shown, are sent from the column K1 to the column K2. Liquid oxygen 31 is extracted from the bottom of the second column K2 and gaseous nitrogen 33 is extracted from the top of the second column. Liquid nitrogen LIN is sent from the top of the second column in certain phases in order to help to keep the method cold. An oxygen rich fluid is sent to the exchanger E to be heated, for example, liquid oxygen 31 can vaporise in the heat exchanger E. A nitrogen rich fluid is sent to the exchanger E to be heated.

The device comprises a first air expansion turbine T1, a second air expansion turbine T2, a first air booster C1 coupled to the first turbine and a second air booster C2 coupled to the second turbine.

Compressed air 1 at a pressure P and originating from a main air compressor (MAC) is divided into two fractions, a first fraction 3 of which is sent to the heat exchanger E without having been compressed at a pressure above the pressure P. A second fraction 5 is sent to the first booster C1, where it is compressed at a pressure above the pressure (P) of the first fraction 3. The outlet of the first booster C1 is connected to the inlet of said booster by a duct 25 through a valve V8.

According to a first variation, the first fraction 3 is cooled in the heat exchanger E to an intermediate temperature thereof and, having not been compressed in the first booster, is sent to the first and the second turbines through the open valve CL3 and the open valves V5, V13, V4, V19.

The second fraction 5 cools in the heat exchanger E to an intermediate temperature thereof, after having been compressed in the first booster C1. It is subsequently sent to the second booster C2.

During normal operation, expanded air originating from the first and second turbines is sent to the first column K1 in order to be separated through the valves V6, V15, V11 and the duct 13. The second fraction 5 is compressed in the second booster C2, passes through the open valve CL1 and is subsequently cooled in the heat exchanger before being sent in liquid form to the first column K1 through the valve V9. The valves V2 and V3 are closed.

If the booster C1 approaches its pumping point, part of the boosted air is taken, after cooling in a cooler downstream of the booster, is allowed to expand by the valve V8 and is sent to the suction side of the booster C1.

If the booster C2, supplied with air 19 originating from an intermediate point of the heat exchanger E, approaches its pumping point, none of the air boosted in the booster C2 is sent to the suction side of the booster C2. The booster C2 does not have any coolant downstream of the booster. If the flow boosted in C2 passes under a threshold indicating that the pumping point is imminent, part of the boosted air is sent via the duct 23, is allowed to expand in the valve V3 and reaches the suction side of the turbine T2 in order to be allowed to expand therein and to be sent to distillation.

The detection threshold of the imminence of the pumping point is defined by defining a pressure drop threshold between two points of the booster, which threshold must not be exceeded. As long as the pressure drop remains below the threshold, all the boosted air is sent to the heat exchanger in order to be liquefied therein.

Once the pressure drop has reached the threshold, the valve is opened that allows the air to pass to the turbine.

The remainder of the boosted air is returned to the heat exchanger E through the valve CL1 and is at least partly liquefied in the exchanger, before being allowed to expand in the valve V9 and being sent to the column K1.

Alternatively, the part of the air sent to the inlet of the turbine T2 can be sent to the outlet thereof arriving in the duct 17. In this case, the air expansion valve will allow this part of the air to expand to a pressure that is slightly above the pressure of the column K1.

It is also possible for the part of the air to be sent to the inlet or the outlet of the turbine T1 instead of to the turbine T2. The air even can be sent to the two turbines T1, T2, to the inlets of the two turbines, to the outlets of the two turbines or to the inlet of one turbine and to the outlet of the other turbine.

According to a second variation, the first fraction 3 is discharged from a heat exchanger at an intermediate temperature thereof and, having not been compressed in the first booster, is sent to the second booster C2.

The second fraction 5 cools in the heat exchanger to an intermediate temperature thereof, after having been compressed in the first booster C1. It is subsequently sent to the first and the second turbines.

Again, in this case, if the booster C2, supplied with air 19 originating from an intermediate point of the heat exchanger E, approaches its pumping point, none of the air boosted in the booster C2 is sent to the suction side of the booster C2. The booster C2 does not have any coolant downstream of the booster.

If the flow boosted in C2 passes under a threshold indicating that the pumping point is imminent, part of the boosted air is sent via the duct 23, is allowed to expand in the valve V3 and reaches the suction side of the turbine T2, without passing through the exchanger E, in order to be allowed to expand in the turbine T2 and to be sent to distillation.

The detection threshold of the imminence of the pumping point is defined by defining a pressure drop threshold between two points of the booster, which threshold must not be exceeded. This pressure difference is equivalent to the minimum flow of air in the booster, which minimum flow must not be passed under. As long as the pressure drop remains above the threshold, all the boosted air is sent to the heat exchanger in order to be liquefied therein.

Once the pressure drop passes under the threshold, the valve is opened that allows the air to pass towards the turbine.

It is also possible to trigger opening of the valve if the air flow in the booster passes under a threshold.

The remainder of the boosted air is returned to the heat exchanger E through the valve CL1 and at least partly liquefies in the exchanger, before being allowed to expand in the valve V9 and being sent to the column K1.

Alternatively, the part of the air sent to the inlet of the turbine T2 can be sent to the outlet thereof arriving in the duct 17. In this case, the air expansion valve will allow this part of the air to expand to a pressure slightly above the pressure of the column K1.

It is also possible for the part of the air to be sent to the inlet or the outlet of the turbine T1 instead of to the turbine T2. The air even can be sent to the two turbines T1, T2, to the inlets of the two turbines, to the outlets of the two turbines or to the inlet of one turbine and to the outlet of the other turbine.

An oxygen rich fluid is sent to the exchanger E to be heated, for example, liquid oxygen 31 can vaporise in the heat exchanger E. A nitrogen rich fluid is sent to the exchanger E to be heated.

The invention is also applicable to the case where the device only comprises a single air turbine coupled to a cold booster.

In this case, in normal operation the air is sent from the cold booster to the heat exchanger. The air then can directly enter the system of columns after being allowed to expand or otherwise can be at least partly sent to the single turbine.

In the event that part of the boosted air liquefies in the heat exchanger and is allowed to expand in a valve V9 upstream of the system of columns, when the air flow boosted in the booster C1 passes under a threshold indicating that pumping is imminent, the flow of liquid passing through the valve V9 can be increased. This valve will then be designed with respect to this operating case.

It is understood that the device can comprise a single cold booster and a single turbine, which may or may not receive air from the cold booster outside a pumping risk period.

This invention is applicable to any method using a cold air booster in a device for separating air by cryogenic distillation. For example, it is applicable to the following methods: FR2943408, WO05064252, EP2831525, JP2015114083, JP54162678, EP1055894, EP2600090, JP2005221199, EP2963370, EP2963369, FR2913670, FR3033397, EP2458311, EP1782011, EP1711765, FR2895068, EP2489968, DE102011121314, EP1014020, FR2985305, DE102006027650, FR2861841, FR3010778, EP644388 and FR2721383.

The inlet temperature of the air booster preferably is between 0° C. and −180° C., even between −60° C. and −180° C.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A device for separating air by cryogenic distillation comprising:

a main air compressor configured to compress all the air to be distilled;

a cold booster configured to boost at least part of the air to be distilled;

an expansion turbine configured to receive compressed air originating from the main air compressor;

a system of cryogenic distillation columns comprising at least one column;

a main heat exchanger in fluid communication with the main air compressor such that the main heat exchanger is configured to receive air from the main air compressor, the main heat exchanger having a warm end, a cold end, and an intermediate section located between the warm end and the cold end, wherein the intermediate section is in fluid communication with the cold booster such that the cold booster is configured to receive air from the intermediate section and then return boosted air to the main heat exchanger;

wherein the expansion turbine is in fluid communication with the intermediate section and is configured to expand air from the intermediate section of the main heat exchanger and then send the expanded air to the system of columns, wherein the cold end of the main heat exchanger is in fluid communication with the system of columns, such that the cold end is configured to receive an oxygen enriched flow and a nitrogen enriched flow from the system of columns;

an expansion valve in fluid communication with an outlet of the cold booster, the expansion valve being configured to expand air boosted in the cold booster to a lower pressure;

an absence of a heat exchanger configured to cool air between the outlet of the cold booster and the expansion valve;

wherein the device is further configured to determine that a pumping point is imminent upon a basis of finding:

i) the pressure drop between two points of the cold booster is under a threshold, or ii) a flow of the cold booster is under a minimum flow of the cold booster, and then:

expand a part of the air boosted in the cold booster without having been cooled between the cold booster and the expansion turbine, and then send the boosted expanded air upstream or downstream of the turbine, without having been cooled in the main heat exchanger therebetween; and in the event of case ii), the device is further configured to increase the flow in the cold booster in order to exit the pumping point.

2. The device according to claim 1, wherein the cold booster is connected to the inlet of the expansion turbine so that the boosted air can be allowed to at least partly expand in the expansion turbine.

3. A method for separating air by cryogenic distillation, the method comprising the steps of:

compressing all air to be distilled in a main air compressor to form compressed air;

cooling the compressed air in a main heat exchanger, the main heat exchanger having a warm end, a cold end, and an intermediate section located between the warm end and the cold end;

introducing a first portion of cooled air from the intermediate section of the main heat exchanger to a cold booster to form a boosted air stream, and then sending the boosted air stream to the main heat exchanger for further cooling;

introducing a second portion of cooled air from the intermediate section of the main heat exchanger to an expansion turbine, and then sending the expanded air to the system of columns;

introducing a fully cooled air stream withdrawn from the cold end of the main heat exchanger to a system of cryogenic distillation columns comprising at least one column, wherein the system of cryogenic distillation columns are configured to produce an oxygen enriched stream and a nitrogen enriched stream;

extracting the oxygen enriched stream and the nitrogen enriched stream from the system of columns and heating the oxygen enriched stream and the nitrogen enriched stream in the main heat exchanger;

determining that a pumping point is imminent upon a basis of finding:

i) the pressure drop between two points of the cold booster is under a threshold; or ii) a flow of the cold booster is under a minimum flow of the booster, and then in response to the pumping point being imminent, the method includes the steps of:

expanding at least a fraction of the boosted air to form an expanded fraction of boosted air;

sending the expanded fraction of boosted air to the system of columns for separation therein, without having been cooled in the main heat exchanger; and in the event of case ii), increasing the flow in the cold booster in order to exit the pumping point.

4. The method according to claim 3, further comprising the steps of determining that a pumping point is not imminent upon a basis of finding the pressure drop between the two points is above the threshold and/or a flow of the cold booster is above the minimum flow of the cold booster, and then sending all the air from the cold booster to the heat exchanger in order to be cooled.

5. The method according to claim 3, wherein, upon a determination that a pumping point is imminent, the method comprises an absence of recycling the boosted air to an inlet of the cold booster.

6. The method according to claim 3, wherein the expanded fraction of boosted air is further expanded in the expansion turbine prior to sending the expanded fraction of boosted air to the system of columns.

7. The method according to claim 3, wherein the expanded fraction of boosted air is expanded to the pressure of a column of the system of columns in an expansion valve, and then mixed with the air originating from the expansion turbine before being sent to the system of columns.

8. The method according to claim 3, further comprising the steps of determining that a pumping point is not imminent upon a basis of the pressure drop between the two points of the cold booster is above the threshold, and then sending all the boosted air to cool in the main heat exchanger.

9. The method according to claim 3, wherein the expansion turbine is coupled to the cold booster.

10. The method according to claim 3, wherein there is an absence of indirect contact cooling for the boosted air that is expanded and then sent to the system of columns between the outlet of the cold booster and the system of columns.

11. The method according to claim 3, wherein the expansion turbine receives air from the cold booster only in the event that a pumping point is imminent.

* * * * *